United States Patent [19]

Devir et al.

[11] Patent Number: 4,752,710

[45] **Date of Patent: * Jun. 21, 1988**

[54] ELECTRIC LAMP WITH INSULATING BASE PROVIDING IMPROVED WIRE RETENTION

[75] Inventors: Daniel D. Devir, Sutton; James P. Szep, Peterborough, both of N.H.

[73] Assignee: GTE Products Corporation, Danvers, Mass.

[ * ] Notice: The portion of the term of this patent subsequent to Jul. 29, 2003 has been disclaimed.

[21] Appl. No.: 816,603

[22] Filed: Jan. 6, 1986

[51] Int. Cl.[4] ..... H01J 5/48; H01J 5/50

[52] U.S. Cl. ..... 313/318; 313/315; 445/27; 439/611; 439/619

[58] Field of Search ..... 313/318, 317, 315, 323, 313/324, 316; 339/276 R, 144 R, 145 R; 445/27

[56] References Cited

U.S. PATENT DOCUMENTS 4,152,622 5/1979 Fitzgerald ..... 313/318

4,603,278 7/1986 Devir et al. ..... 313/318

*Primary Examiner*—David K. Moore

*Assistant Examiner*—Mark R. Powell

*Attorney, Agent, or Firm*—Lawrence R. Fraley

[57] ABSTRACT

An improved electric lamp including an electrically insulating (e.g., plastic) base which is securedly positioned on the lamp's sealed end portion without the need for adhesives or the like. The base functions to securedly retain the lamp's lead-in wires (a total of four in a dual filament lamp) in a preestablished alignment externally of the lamp's sealed end (from which the wires project) to thereby assure positive electrical connection thereto when the lamp and base are inserted within a corresponding electrical socket. This wire retention is possible by embedding each conductor within designated channels in the base and subsequent deformation of the base's material to substantially cover the embedded wire. In addition, a locking arrangement between the lamp envelope's press sealed end and the base is provided to assist in retaining the sealed end within an opening within the base. The invention is ideally suited for use in a tail light assembly for an automobile.

9 Claims, 2 Drawing Sheets

ELECTRIC LAMP WITH INSULATING BASE PROVIDING IMPROVED WIRE RETENTION

TECHNICAL FIELD

The invention relates to electric incandescent lamps and, more particularly, to such lamps which include an electrically insulating base as part thereof.

CROSS REFERENCE TO COPENDING APPLICATION

In Ser. No. 580,929, filed Feb. 16, 1984 and entitled "Electric Lamp With Insulating Base" (Inventors: D. Devir et al), there is defined an electric lamp having an electrically insulating base wherein lead-in conductors are retained therein in fixed alignment to facilitate electrical connection when the base is positioned within a respective socket. Ser. No. 580,929 is assigned to the same assignee as the instant application. The invention defined therein is thus owned by the assignee of the present invention and was so owned at the time the present invention was made. Ser. No. 580,929 is now U.S. Pat. No. 4,603,278.

BACKGROUND

The features of the present invention are particularly useful as applied to the construction of incandescent lamps employed in automobiles, such as the dual-filament lamps employed in tail light assemblies.

One well known example of existing lamps of this type generally employ a type S-8 glass bulb cemented in a brass, double contact bayonet base. Although used for a number of years, such bases pose a number of disadvantages. For example, anyone who has replaced such a lamp in their automobile will appreciate the great difficulty experienced in position-referencing the base to insure the proper lamp-to-socket orientation. The base is usually cylindrical in shape and the only orientation reference means are small indexing pins at the sides thereof. This referencing problem also holds true for automatic insertion of the lamp into the socket during production thereof. Further, the lamp to base construction for dual filament lamps of this type requires three soldering points for electrical connections (the two lead-in wires serving as the common connection are twisted and soldered to the sidewall of the base, while the other two wires are respectively soldered to the twin contact nodes at the bottom of the base). This leads to corrosion or other contact degradation problems caused by soldering fluxes. Finally, the bayonet base lamp requires a somewhat complicated and relatively expensive socket design.

One attempted solution to the several aforementioned problems inherent in brass base lamps is defined in U.S. Pat. No. 4,028,577 (P. E. Gates et al), said patent assigned to the same assignee as the instant invention and being a continuation-in-part of U.S. Pat. No. 3,979,627 (S. J. Leadvaro et al). In U.S. Pat. No. 4,028,577, there is described an electric lamp having a sealed end containing therein (or extending therefrom) a reentrant glass stem sealed about its periphery to the glass bulb. This end is positiond within a plastic base having a cylindrical body portion (for housing the somewhat cylindrical-shaped sealed end) and adjacent wedge portion. While this concept has proven advantageous in several ways over the aforementioned brass base lamps, it is necessary to provide additional features, steps, etc. in order to satisfactorily produce and utilize this arrangement. For example, it is necessary to position the extending top segment (from the sealed end) a sufficient distance from the base's inner, bottom wall in order to provide protection thereof. Maintenance of this distance is assured by cementing the bulb (along the outer walls) to the base. It is also necessary in this design to pass the lamp's projecting lead-in wires through corresponding passages (holes) within the base, thus mandating a relatively complex (and time-consuming) alignment and insertion procedure. Even further, final lead-in wire retention necessitates yet another production step (e.g., heat staking) which adds still further to the cost of this lamp.

In the aforementioned U.S. Pat. No. 4,630,278, there is defined an electric lamp and base assembly wherein many of the several problems inherent in such prior art designs are overcome. Specifically, the assembly defined therein utilizes a base member wherein projecting ends of the assembly's lead-in conductors (wires) are oriented in spaced orientation along the opposing sides of the base and inserted within corresponding, similarly shaped apertures also within the base. In effect, a friction fit between the base and each wire is provided. On occasion, it has been determined that such a retention may prove insufficient to completely maintain the conductors in the desired fixed orientation. That is, on some occasions (e.g., wherein high tension forces were applied to both lamp envelope and base), the terminal ends of the conductors have become withdrawn from their respective base apertures.

The instant invention overcomes this undesirable feature by providing enhanced conductor retention within the base and, in addition thereto, means for providing additional restraint on the sealed end of the lamp within the base's socket. Such an invention is deemed to constitute a significant advancement in the art.

DISCLOSURE OF THE INVENTION

It is, therefore, a primary object of this invention to enhance the electric lamp art.

It is a particular object of this invention to provide an electric lamp which is relatively simple in design, can be readily and inexpensively produced, and which eliminates the need for soldering or the like and the typical problems associated therewith.

It is yet another object of this invention to provide such a lamp wherein the lamp's projecting lead-in wires are both positively aligned and retained externally of the lamp's sealed end in a more positive manner than that described in U.S. Pat. No. 4,603,278 to thereby assure sound electrical connection thereto when the lamp is positioned (e.g., inserted) within a corresponding socket component and/or removed therefrom for possible reinsertion.

These and other objects, advantages and features are attained, in accordance with the principles of this invention, by an improved electric lamp including a sealed, light-transmitting envelope having a bulbous portion and a press ealed end portion, at least one filament located within the interior of the bulbous portion of the envelope, a pair of lead-in conductors each connected to the filament and sealed within the press sealed end portion of the envelope and exteriorly projecting therefrom, and an electrically insulating base member secure to the press sealed end portion of the envelope adjacent the bulbous portion. Exteriorly protruding portions of the lead-in conductors are positively secured within the first portion of the base in predetermined alignment against a respective external surface of the insulating base member's second portion by embedding each therein and deforming the base material to substantially cover the embedded conductor.

BEST MODE FOR CARRYING OUT THE INVENTION

Figure 1:
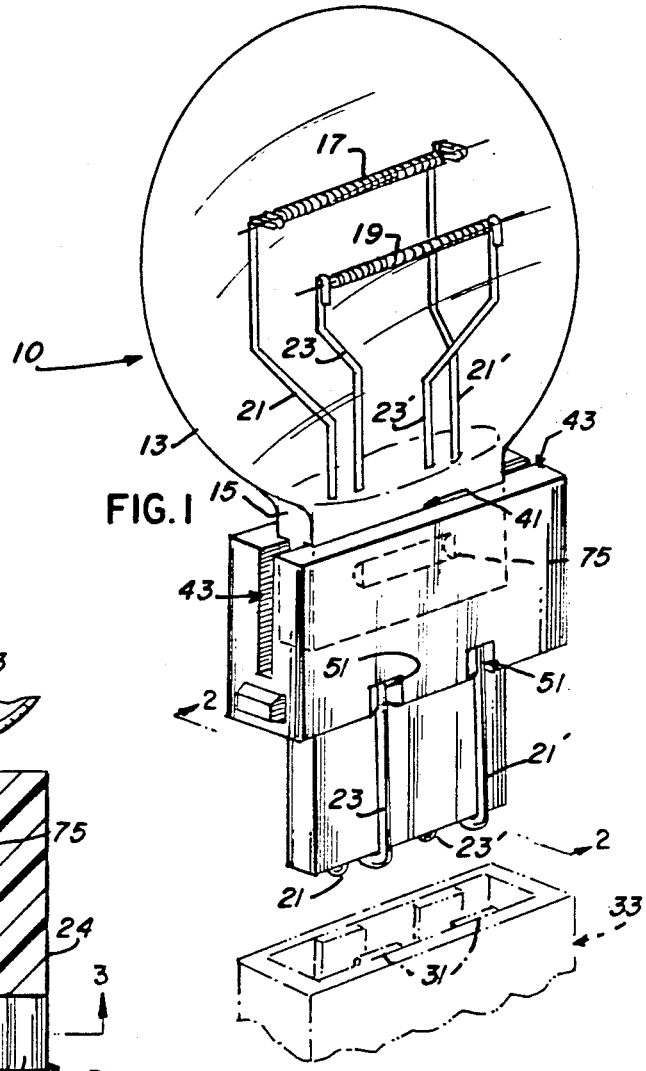
FIG. 1 is a perspective view of an incandescent lamp in accordance with the principles of the instant invention.

For a better understanding of the present invention together with other and further objects, advantages and capabilities thereof, reference is made to the following disclosure and appended claims in connection with the above-described drawings.

With particular attention to the drawings, there is illustrated an improved electric incandescent lamp 10 in accordance with the teachings of the invention. Lamp 10, as stated above, represents an improvement over the lamp in U.S. Pat. No. 4,603,278 and, as described therein, is particularly adapted for use as part of a tail light assembly in an automobile. It is also understood from the teachings herein, however, that the invention has many further uses (e.g., automobile dashboard and aircraft instrument lighting, telephone switchboard lighting, etc). and the teachings herein are thus not limited to this particular area. Lamp 10, similar to that in Ser. No. 580,929, includes a light-transmitting envelope in the form of a glass (e.g., lime glass) bulb 13, said bulb containing therein a rare gas such as argon established at approximately atmospheric pressure. Bulb 13 is press (pinch) sealed at one end thereof using a pressing operation known in the incandescent lamp industry. Accordingly, further description of this operation is not believed necessary. As a result of this pressing operation, a flattened, sealed end portion 15 is formed as part of bulb 13 adjacent the bulbous part of the envelope. End portion 15 is of substantially rectangular configuration when viewed in cross section therethrough, in comparison to the bulbous shape of bulb 13, which may be either substantially cylindrical (tubular) or spherical (round) in shape. As will be explained in greater detail below, forming end portion 15 in the manner and shape defined constitutes an important aspect of the invention. More specifically, end portion 15 as formed by such a pressing technique possesses greater strength (resistance to breakage) over ends sealed using a tipping operation or the like, or sealed in the manner defined in the aforementioned U.S. Pat. Nos. 3,979,627 and 4,028,577. In addition, the substantially rectangular (in cross section) shape resulting from this technique is particularly suited for placement thereon of an insulative base possessing the unique features also taught hereinbelow.

Located within bulb 13 is a pair of filaments 17 and 19, each of which is electrically connected to (and secured by) a corresponding pair of lead-in conductors which are hermetically sealed within end portion 15 of bulb 13 and project exteriorly thereof. The opposing ends of each pair extend within the interior of bulb 13 and may be formed (e.g., bent) as indicated to assure the desired positioning for both filaments. With particular attention to the drawings, filament 17 is connected (and energized) by lead-in conductors 21 and 21', while filament 19 is connected by conductors 23 and 23'. A total of four conductors thus project exteriorly from sealed end portion 15.

In one embodiment of the invention, filaments 17 and 19 are each of coiled configuration and comprised of tungsten. By the term coiled configuration is meant that each filament may constitute a singular coil or, alternatively, may be a coiled-coil member. Retention of each filament by the associated pair of lead-in conductors is attained by crimping the interior ends thereof over the opposed ends of the linear filament, said procedure known in the art of incandescent lamp making. Each lead-in conductor may be comprised of a metallic alloy material (e.g., dumet) or similar conductive material known in the art. In one embodiment, each conductor possessed an outer (external) diameter (O.D.) of about 0.020 inch and a total length of about 2.700 inch, of which about 1.400 inch projects externally from end portion 15. It is thus understood that a substantial (more than half) portion of each conductor projects exteriorly of sealed end 15.

Lamp 10 further includes an electrically insulating (e.g., plastic) base member 25 which, as shown, is secured to the press sealed end portion 15 of the lamp's envelope ajdacent the bulbous portion 13. Base member 25 is thus designed for providing a cover for end 15. Base member 25 is of unitary construction and includes a relatively larger first portion 24 and a smaller (in thickness) protruding second portion 24' adjacent first portion 24. Located within second portion 24' are a plurality of apertures 26 (one shown in FIG. 2) each of which extend through the protruding portion 24' and are designed for having a respective exteriorly projecting portion of a lead-in conductor pass therethrough. Although individual apertures 26 are provided for each conductor, it is also possible to utilize a single slot (or channel) for this purpose, wherein all conductors are located therein in a side-by-side, non-contacting (to assure electrical insulation) relationship. The exteriorly protruding portions of the four lead-in conductors are maintained in predetermined alignment within an external surface of a respective one of the sidewalls of the base's larger first portion and thus capable of being precisely aligned with corresponding electrical contacts (i.e., 31, shown in phantom in FIG. 1) as might be utilized in a socket 33 (also shown in phantom in FIG. 1) into which the invention is designed for being positioned. As understood herein, positioning of base member 25 is accomplished by inserting the protruding second portion 24' directly within a socket such as illustrated in FIG. 1 such that connection is made to the retained and aligned exposed portions of the respective lead-in conductors 21, 21', 23 and 23' in the region of this protruding second portion (and thereby against this portion). It is thus possible to provide a socket member of relatively simple construction capable of receiving the instant invention.

Figure 2:
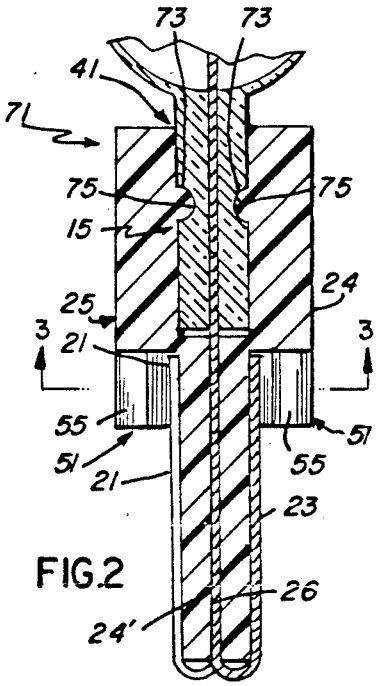
FIG. 2 is an enlarged, side elevational view of the lamp of FIG. 1 as taken along the line 2—2 in FIG. 1.

Base member 25, as stated, is of unitary construction and defines therein an elongated opening 41 also of substantially rectangular configuration and designed for having the flattened press sealed end portion 15 securedly positioned therein. Opening 41 extends into the first portion 24 of base member 25 an established depth, as indicated in FIG. 2. To assure positive positioning therein without causing damage to the sealed end portion 15, the first portion 24 of base member 25 further includes flexure means 43 therein to enable this part of the base member to expand a predetermined amount during said positioning. Flexure means 43 is preferably in the form of two elongated slots formed within the narrower interconnecting sidewalls of the base member's first portion to thus enable the upper parts of the larger sidewalls to expand outwardly during positioning of the press sealed end portion 15. Preferably, two slots are utilized, although it is possible that only one of these may be provided. End portion 15 is thus firmly positioned within base member 25 without the need for cement or the like.

To maintain the externally projecting portions of the four lead-in conductors (those portions which project from the protruding second portion 24' of base member 25) in the described predetermined alignment and thereby assure effective contact therewith at the location indicated, base member 25 further includes a plurality of spacedly positioned channels 51, each located within the lowermost portion of the larger first portion 25 of the base member and designed for having one of the terminal ends of a respective conductor inserted therein. As will be described below, each of these terminal ends is secured within base 25 in a locking relationship to thus prevent subsequent removal thereof during the aforementioned positioning of the invention within a corresponding socket member. Such retention also serves to assist in maintaining end portion 15 of lamp 10 firmly within base 25. A total of four channels are provided, one for each of the mentioned lead-in conductors. It is understood in the broader aspects of its invention, however, that only two such channels may be provided in the event that only one filament is utilized (and thus only two lead-in conductors similarly employed). Because it is desired to position the conductors from each filament on opposite sides of the base member's first portion 24, it is understood that if only two channel members are employed, these would also be oriented within said opposite sides (or sidewalls) of the first portion.

Figure 3:
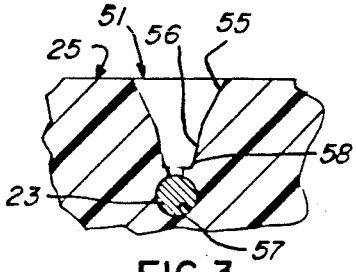
FIG. 3 is an enlarged, end elevational view, in section, of the lamp of FIG. 1 as taken along the line 3—3 in FIG. 2.

As better depicted in FIGS. 2 and 3, each channel includes a first tapered portion 55 which, as illustrated, facilitates positioning of the substantially annular (round) conductors therein. In addition, each channel further includes a second tapered portion 56 and an annular opening 57 at the bottom thereof (having conductor 23 located therein). With particular attention to FIG. 3, each of the illustrated first tapered portions 55 abuts a respective one of the second tapered portions 56, which in turn are each adjacent to the corresponding annular opening 57.

As stated, the instant invention defines a means for more positively securing the invention's lead-end conductors within the larger, upper portion of base member 25. Even more particularly, the invention defines a means whereby each of the terminal ends of the conductors is embedded a predetermined distance within the base member's first portion and substantially covered by a quantity of deformed material of the base. This arrangement is illustrated in FIG. 3 wherein a relatively small quantity 58 of material of the base is shown covering conductor 23. Such an arrangement has proven to significantly increase retention of the individual conductors and prevent withdrawal (removal) thereof from the invention's channels during exertion of forces on both lamp envelope and plastic base. In one example, the lamp envelope and base members were each subjected to a series of "push-pull" tests wherein said members were subjected to opposing tensile forces in an attempt to effect separation thereof. In embodiments of the lamp as defined in U.S. Pat. No. 4,603,278, forces within the range of about 15 to 22 pounds proved sufficient to effect withdrawal of at least one terminal end of the wire conductors from the respective openings within the base member. In accordance with the teachings of the invention, wherein these ends are firmly embedded and covered with deformed base material, forces of approximately 50 pounds were required before such withdrawal occurred. This is deemed to constitute a significant improvement over the earlier embodiment in U.S. Pat. No. 4,603,278.

Figure 4A:
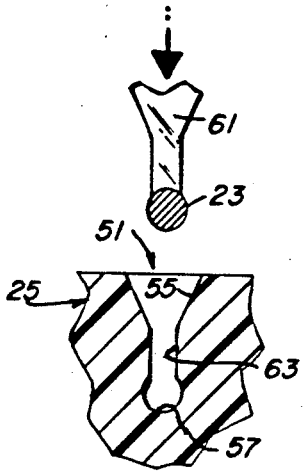
FIGS. 4A–4C illustrate the technique for embedding the invention's conductors and thereafter deforming the base member to substantially cover and thus firmly retain the conductors.
Figure 4B:
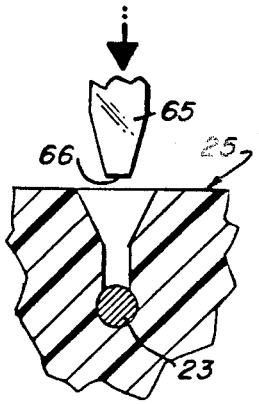
Figure 4C:
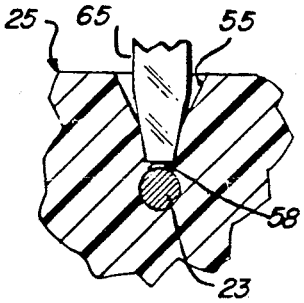

In FIGS. 4A–4C, there is shown the preferred technique for embedding the conductors of the instant invention within base member 25 and for defining the ultimate configuration for channels 51. In FIG. 4A, the respective conductor 23 is shown as being positioned above a respective channel 51 within base member 25. The conductor is engaged by a first tool member 61 and pushed downwardly (see the directional arrow) toward channel 51. Of significance, channel 51 includes the aforedefined first tapered portion 55 and the annular opening 57. Interconnecting these two portions of channel 51, however, is a straight-sided, interim opening 63 having an overall width substantially similar to or only slightly smaller than the diameter of conductor 23. This conductor is simply inserted within opening 57 and tool member 61 is subsequently withdrawn. Such placement is depicted in FIG. 4B. Once accomplished, a second tool member 65 is then lowered (see the directional arrow in FIG. 4B) to engage the end portions of tapered walls 55 nearest the aforementioned straight-sided portion 63. The forward end 66 of this forming tool member thus causes deformation of the plastic material so as to form the double tapered configuration depicted in FIG. 4C (and FIG. 3). As shown in FIG. 4C, the aforementioned relatively small quantity 58 of deformed material of the base member is compressed against conductor 23 to thus assure that the conductor is firmly embedded. The second tool member 65 is then withdrawn and the product as depicted in FIG. 3 is the result thereof. The preferred first and second tool members as shown in FIGS. 4A–4C are of metal (e.g., steel) and are thus readily capable of deforming the softer plastic material of base member 25 during production of the invention.

To further assist in retention of the invention's conductors in the manner described herein, lamp 10 further includes means 71 (FIG. 2) for substantially retaining the press sealed end 15 of the lamp within the described opening 41 of the upper, larger portion of base 25. Means 71, as shown in FIG. 2, includes at least one protruding segment 73 which projects from an internal wall of the opening to extend therein. Preferably two such segments are utilized and positioned in an opposing relationship (on opposite side walls) as illustrated in FIG. 2. Each of these protruding segments is designed for being aligned with and subsequently located within a corresponding recessed portion 75 of press sealed end 15. One such recessed portion 75 is shown (hidden) in FIG. 1. When the press sealed end of lamp 10 is inserted within base member 25, each of the protruding segments 73 is inserted within the corresponding recesses 75, the result being that the press sealed end is substantially "locked" in position. Understandably, this positioning is facilitated by the ability of the first portion of base member 25 to expand (flex) outwardly during this insertion. It must again be emphasized that this retention of base 25 is achieved without the need for cement or the like.

There has thus been shown and described an electric lamp wherein the externally projecting lead-in conductors thereof are positively retained in a predetermined alignment to enable positive connection thereto by the respective contacts or the like located within a socket member in which the lamp is positioned. The combination as defined herein provides a lamp wherein the protruding, second portion of the base member, having the conductors retained therein, may be directly inserted within a suitable socket member to thus assure positive electrical connection of the type defined without causing damage to the invention, and in addition thereto, without causing removal (withdrawal) of the secure conductors.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an electric lamp including a sealed, light-transmitting envelope having a bulbous portion and a press sealed end portion, at least one filament located within the interior of said bulbous portion of said envelope, a pair of lead-in conductors each connected at one end thereof to said filament, each of said conductors sealed within said press sealed end portion of said envelope and projecting exteriorly thereof, and an electrically insulating base member including a first portion having an opening therein and a protruding second portion adjacent said first portion, said press sealed end portion of said envelope being securedly positioned within said opening, said first portion of said base member thereby providing a cover for said press sealed end portion and including a pair of channels located within a sidewall thereof and each including a first tapered portion therein, each of said exteriorly projecting portions of said conductors passing through said protruding second portion and protruding externally thereof, said externally protruding portions of said conductors being maintained in predetermined alignment within a respective one of said channels within said first portion of said base member and against a respective external surface of said protruding second portion of said base member such that electrical contact can be provided at said external protruding portions of said conductors in the region of said protruding second portion, the improvement wherein each of said conductors is embedded a predetermined distance within said respective channel and said channel is thereafter deformed to define a second tapered portion and a quantity of deformed material such that each of said conductors is substantially covered by said quantity of deformed material to positively secure each of said conductors within said respective channel within said first portion.

2. The improvement according to claim 1 wherein each of said channels includes a substantially annular opening located substantially adjacent said second tapered portion for having said conductor located therein.

3. The improvement according to claim 2 wherein each of said second tapered portions is located intermediate said respective first tapered portion and said substantially annular opening and is formed during deformation of said base member.

4. The improvement according to claim 1 further including means for substantially retaining said press sealed end of said envelope within said opening within said first portion of said base.

5. The improvement according to claim 4 wherein said retaining means comprises at least one protruding segment located on or forming part of said first portion of said base member within said opening, said press sealed end of said envelope including a recessed portion therein, said protruding segment aligning with and being positioned within said recessed portion when said press sealed end is positioned within said base member.

6. The improvement according to claim 5 wherein said first portion of said base member further includes therein flexure means for enabling said first portion of said base member to expand a predetermined amount during positioning of said press sealed end portion of said envelope within said opening within said first portion.

7. The improvement according to claim 6 wherein said flexure means comprises at least one elongated slot located within a sidewall of said first portion of said base member.

8. The improvement according to claim 7 wherein the number of said elongated slots is two, each located within a respective one of two spaced-apart sidewalls of said first portion of said base member.

9. The electric lamp according to claim 1 wherein said envelope is glass and said base member is plastic.

* * * * *